US006313575B1

(12) United States Patent
Kimiya et al.

(10) Patent No.: US 6,313,575 B1
(45) Date of Patent: Nov. 6, 2001

(54) COLOR PICTURE TUBE

(75) Inventors: Junichi Kimiya, Fukaya; Fumitaka Hoshino, Gumma-ken; Shigeru Sugawara, Saitama-ken, all of (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/142,606

(22) PCT Filed: Jan. 13, 1998

(86) PCT No.: PCT/JP98/00088

§ 371 Date: Sep. 9, 1998

§ 102(e) Date: Sep. 9, 1998

(87) PCT Pub. No.: WO98/31040

PCT Pub. Date: Jul. 16, 1998

(30) Foreign Application Priority Data

Jan. 13, 1997 (JP) ..... 9-003923

(51) Int. Cl.[7] ..... H01J 29/51; H01J 29/54

(52) U.S. Cl. ..... 313/414; 313/412; 313/413

(58) Field of Search ..... 313/412, 414, 313/443; 250/396, 398, 400, 396 ML; 348/806, 809

(56) References Cited

U.S. PATENT DOCUMENTS

| | | | | |
|---|---|---|---|---|
| 3,906,279 | * | 9/1975 | Linssen | 313/409 |
| 4,701,678 | | 10/1987 | Blacker et al. . | |
| 4,890,032 | | 12/1989 | Bijma et al. . | |
| 4,935,663 | * | 6/1990 | Shimoma et al. | 313/412 |
| 5,081,393 | * | 1/1992 | Kinami | 313/412 |
| 5,449,983 | * | 9/1995 | Sugawara et al. | 315/382 |
| 5,519,290 | * | 5/1996 | Sugawara et al. | 315/382.1 |
| 5,663,609 | * | 9/1997 | Kamohara et al. | 313/412 |
| 5,751,100 | * | 5/1998 | Kim | 313/414 |
| 5,905,331 | * | 5/1999 | Misono | 313/413 |
| 5,939,820 | * | 8/1999 | Jo | 313/449 |
| 6,016,030 | * | 1/2000 | Amano et al. | 313/414 |

FOREIGN PATENT DOCUMENTS

| | | |
|---|---|---|
| 43 44 237 | 9/1994 | (DE) . |
| 302 657 | 2/1989 | (EP) . |
| 798 759 | 10/1997 | (EP) . |
| 6-68957 | 8/1994 | (JP) . |
| 7-52630 | 6/1995 | (JP) . |

OTHER PUBLICATIONS

Patent Abstract of Japan, vol. 095, No. 011, Dec. 26, 1995.
IDW 97 (Preceedings of the Fourth International Display Workshops) CRT3–2 " A New Electron Gun for 41cm Mini–Neck Color Display Tube " Nov. 19–21, 1997 F. Hoshino et al.

* cited by examiner

*Primary Examiner*—Michael H. Day
*Assistant Examiner*—Matthew J. Gerike
(74) *Attorney, Agent, or Firm*—Pillsbury Winthrop LLP

(57) ABSTRACT

A color picture tube which prevents a change in convergence due to current leaked from a resistor during operation of the color picture, thus, providing a stable and satisfactory convergence characteristic in the overall region of the screen. The color picture tube comprises a main electron lens portion, a deflection yoke, and an inline electron gun that includes an electron beam generating portion for generating three electron beams in line consisting of a center beam and a pair of side beams. Distances between the center axis of the center beam passage hole and that of each of the side beam passage holes in a first electrode (G5), a second electrode (GM) and a third electrode (G6) are represented by Sg(1), Sg(2) and Sg(3). The first and second electrodes are separated by a gap L(1); and the second and third electrodes are separated by a gap L(2). The distance Sg(2) is set to satisfy the relationship:

$$Sg(2)=\{L(1)\times Sg(3)+L(2)\times Sg(1)\}/\{L(1)+L(2)\}.$$

5 Claims, 3 Drawing Sheets

COLOR PICTURE TUBE

This application is the national phase of international application PCT/JP98/00088 filed Jan. 13, 1998 which designated the U.S.

TECHNICAL FIELD

The present invention relates generally to a color picture tube, and more particularly to a color picture tube in which an electron gun having a large-diameter main lens is mounted.

BACKGROUND ART

In general, a color picture tube is constructed to display a color image by scanning a phosphor screen in horizontal and vertical directions by a plurality of electron beams emitted from an electron gun.

An example of the electron gun applied to the color picture tube is an inline electron gun, which emits three electron beams in line: a center beam and a pair of side beams on both sides of the center beam, all traveling on the same horizontal plane. A main lens portion of the electron gun is constituted by grids. The center axes of side beam passage holes, through which side beams pass in a grid on the higher voltage side of all the grids, are decentered to outer sides than those of a grid on the lower voltage side. In other words, the center axes of side beam passage holes in a grid on the higher voltage side are located on outer portions, which apart from center beam, than those of a grid on the lower voltage side. As a result, the three electron beams are converged in a central portion of the screen. The three electron beams aligned in line can be self-converged in all the region of the screen, if a deflection field is pincushion-shaped in the horizontal direction, i.e., the inline direction in which the electron beams are aligned, and barrel-shaped in the vertical direction, i.e., the direction perpendicular to the inline direction.

Of the electron guns used in the color picture tube, a type of electron gun for improving the focus characteristic in all the region of the screen is disclosed in, for example, Jpn. Pat. Appln. KOKAI Publication No. 64-38947. The electron gun is called an extended field type electron gun, which comprises a number of focusing grids, and in which part of an anode voltage is resistance-divided by a resistor arranged within a neck of the color picture tube, so that the divided voltages can be supplied to the grids, thereby forming a large-diameter main lens having a long focus by moderate potential distribution.

FIGS. 1A and 1B show an example of the extended field type electron gun.

As shown in FIG. 1A, the electron gun comprises three cathodes KB, KG and KR aligned in line, each incorporating a heater (not shown) for emitting electron beams. The electron gun further comprises a first grid 10, a second grid 20, a third grid 30, a fourth grid 40, a fifth grid 50, a plurality of intermediate electrodes 70 and 80, a sixth grid 60 and a convergence cup 90. These components are arranged in this order in the direction of travel of the electron beams and supported and fixed to each other by an insulating support (not shown).

A resistor 100 is provided near the electron gun, as shown in FIG. 1B. One end 110 of the resistor 100 is connected to the sixth grid 60, while the other end 120 is grounded. Intermediate points 130 and 140 are respectively connected to the intermediate electrodes 70 and 80. The end 110 of the resistor 100 is also connected to an operation voltage supplying device 131.

As shown in FIGS. 1A and 1B, the first grid 10 is a thin plate electrode having three beam passage holes of a small diameter to allow passage of electron beams. The second grid 20 is also a thin plate electrode having three beam passage holes of a small diameter to allow passage of electron beams.

The third grid 30 is formed of two cup electrodes 31 and 32, open ends of which are joined together. The cup electrode 31, on the side of the second grid, has three beam passage holes having a diameter slightly larger than that of the beam passage holes formed in the second grid 20. The cup electrode 32, on the side of the fourth grid, has three beam passage holes having a large diameter.

The fourth grid 40 is formed of two cup electrodes 41 and 42, open ends of which are joined together. Each of the cup electrodes 41 and 42 has three beam passage holes, having a large diameter. The fifth grid 50 is formed of a plurality of cup electrodes 51, 52, 53 and 54, each having three beam passage holes having a large diameter.

The intermediate electrodes 70 and 80 are thick plate electrodes, each having three beam passage holes of a large diameter. The sixth grid 60 is formed of two cup electrodes 61 and 62, open ends of which are joined together. Each electrode has three beam passage holes having a large diameter. The convergence cup 90 is fixed to the bottom of the cup electrode 62.

A DC voltage of about, for example, 100 to 150V and a modulation signal corresponding to an image superimposed thereon are applied to the three cathodes KB, KG and KR. The first grid 10 is grounded. The second and fourth grids 20 and 40 are connected to each other in the tube, and a DC voltage of about 600 to 800V is applied thereto.

The cathodes KB, KG and KR, the first grid 10 and the second grid 20 constitute a triode. The triode emits electron beams and forms a crossover.

The third and fifth grids 30 and 50 are connected to each other in the tube, and a focusing voltage of about 6 to 9 kv is applied thereto. An anode voltage of about 25 to 30 kV is applied to the sixth grid 60.

The second and third grids 20 and 30 form a prefocus lens, which preliminarily focuses the electron beams emitted from the triode.

The third, fourth and fifth grids 30, 40 and 50 form an auxiliary lens, which further preliminarily focuses the electron beams output from the prefocus lens.

A voltage corresponding to about 40% of the anode voltage is applied to the intermediate electrode 70 by the resistor 100 provided near the electron gun. A voltage corresponding to about 65% of the anode voltage is applied to the intermediate electrode 80. Thus, the voltages of the values substantially intermediate between the voltages, applied to the fifth and sixth grids 50 and 60, are applied to the intermediate electrodes 70 and 80.

In the above structure, the fifth grid 50, the intermediate electrodes 70 and 80 and the sixth grid 60 form a main lens, which finally focuses the electron beams on the screen. The main lens, having a main lens region extended by the intermediate electrodes 70 and 80, is called an extended field lens.

The side beam passage holes formed in the intermediate electrode 80 and the cup electrode 61 are decentered to outer sides from the center axes of the holes. Therefore, the side beams are deflected toward the center beam, with the result that the three electron beams are converged substantially at the center of the screen.

In the conventional electron gun of the extended field type, the main lens formed of the fifth grid 50, the intermediate electrodes 70 and 80 and the sixth grid 60 has a large diameter, so that the focusing performance in the all region of the screen is greatly improved. However, while the color picture tube is operating, the current tends to leak from the resistor 100 arranged within the neck. Since no measures to cope with the current leak are taken in the conventional electron gun, if the current leaks, the voltages applied to the intermediate electrodes 70 and 80 are unstable, resulting in change in the focusing characteristic of the main lens. If the focusing characteristic changes, a so-called convergence characteristic, for converging the three electron beams onto one point, also varies on the phosphor screen side.

DISCLOSURE OF INVENTION

The present invention has been made to solve the above problems, and its object is to provide a color picture tube which prevents a change in convergence characteristic due to a current leaked from the resistor arranged in the neck during an operation of the color picture tube, so that a stable and satisfactory convergence characteristic can be obtained in the overall screen.

According to an aspect of the present invention, there is provided a color picture tube comprising: an inline electron gun including an electron beam generating portion (KR, KG, KB, G1, G2) for generating three electron beams in line consisting of a center beam (6G) and a pair of side beams (6R, 6B) on both sides of the center beam, all traveling on a same horizontal plane, and a main electron lens portion (G5, GM, G6) formed of a plurality of grids for focusing the three electron beams on a target (3); and a deflection yoke for generating a magnetic field for deflecting the electron beams emitted from the electron gun to scan the target, wherein the main electron lens portion comprises an n-number of grids (first, second, . . . k-th, . . . and n-th grids), arranged in this order in a direction of travel of the electron beams, the first and second grids being separated by a gap L (1), the second and third grids being separated by a gap L (2), and the k-th and (k+1)-th grids being separated by a gap L (k), and the (k−1)-th grid (G5), the k-th grid (GM) and the (k+1)-th grid, (G6) forming at least two adjacent gaps L (k−1) and L (k), comprising deflection means for deflecting the paths of the pair of side beams on the same horizontal plane, and the deflection means comprised of the (k−1)-th grid, the k-th grid and the (k+1)-th grid is constructed so that an amount of deflection of the side beams per unit voltage difference in the gap L (k−1) is substantially equal to an amount of deflection of the side beams per unit voltage difference in the gap L.

According to another aspect of the present invention, there is provided a color picture tube comprising: an inline electron gun including an electron beam generating portion (KR, KG, KB, G1, G2) for generating three electron beams in line consisting of a center beam (6G) and a pair of side beams (6R, 6B) on both sides of the center beam, all traveling on a same horizontal plane, and a main electron lens portion (G5, GM, G6) formed of a plurality of grids for focusing the three electron beams on a target (3); and a deflection yoke for generating a magnetic field for deflecting the electron beams emitted from the electron gun to scan the target, wherein the main electron lens portion comprises an n-number of grids (first, second, . . . k-th, . . . and n-th grids), arranged in this order in a direction of travel of the electron beams, the first and second grids being separated by a gap L (1), the second and third grids being separated by a gap L (2), and the k-th and (k+1)-th grids being separated by a gap L (k), the (k−1)-th grid, the k-th grid and the (k+1)-th grid forming at least two adjacent gaps L (k−1) and L (k), comprising deflection means for deflecting the paths of the pair of side beams on the same horizontal plane, wherein distances between a center axis of a center beam passage hole which center beam passes through and that of each of side beam passage holes which side beams pass through are represented by Sg (1), Sg (2) and Sg in the first, second and k-th grids, the distance Sg in the k-th grid being set to satisfy the following relationship:

$$Sg(k) = \frac{L(k-1) \times Sg(k+1) + L(k) \times Sg(k-1)}{L(k-1) + L(k)}. \quad \text{(equation 1)}$$

BEST MODE OF CARRYING OUT THE INVENTION

An embodiment of a color picture tube of the present invention, particularly, an electron gun applied to the color picture tube will be described with reference to the accompanying drawings.

Figure 1A:
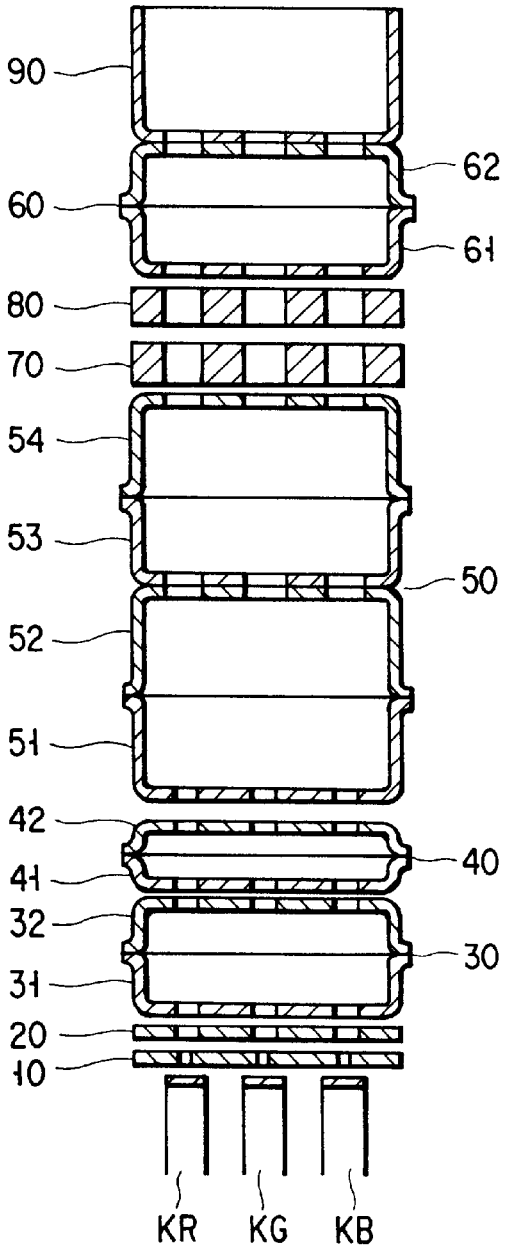
FIG. 1A (PRIOR ART)
FIG. 1A is a schematic cross-sectional view of an electron gun applied to a conventional color picture tube, taken along a line perpendicular to the inline direction.
Figure 1B:
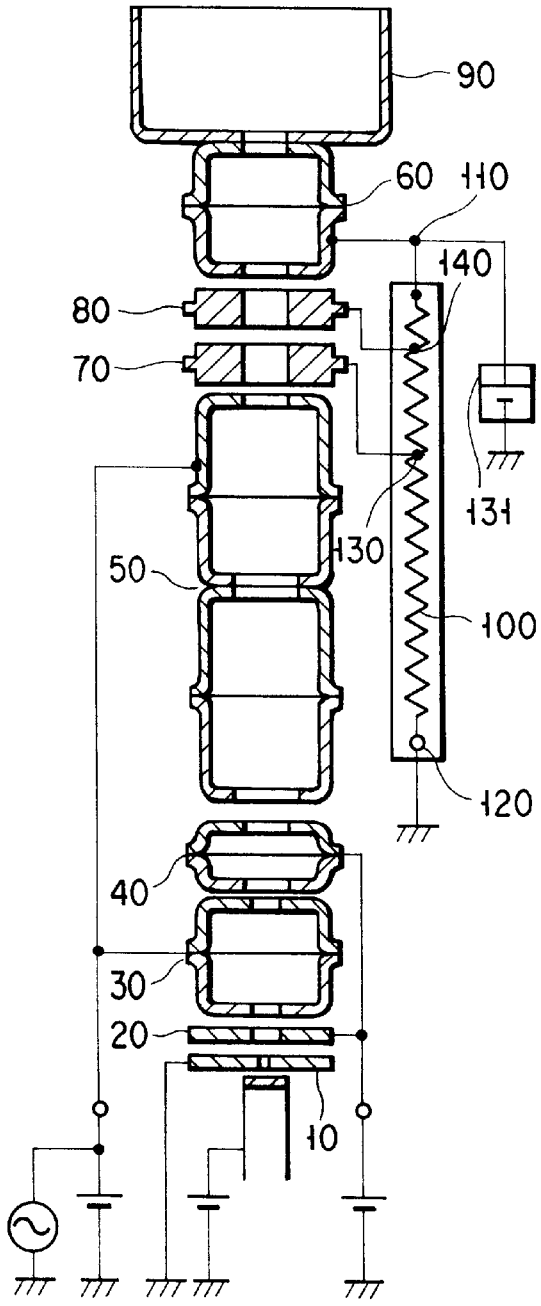
FIG. 1B (PRIOR ART)
FIG. 1B is a schematic cross-sectional view of the electron gun shown in FIG. 1A, taken along a line in the inline direction.
Figure 2:
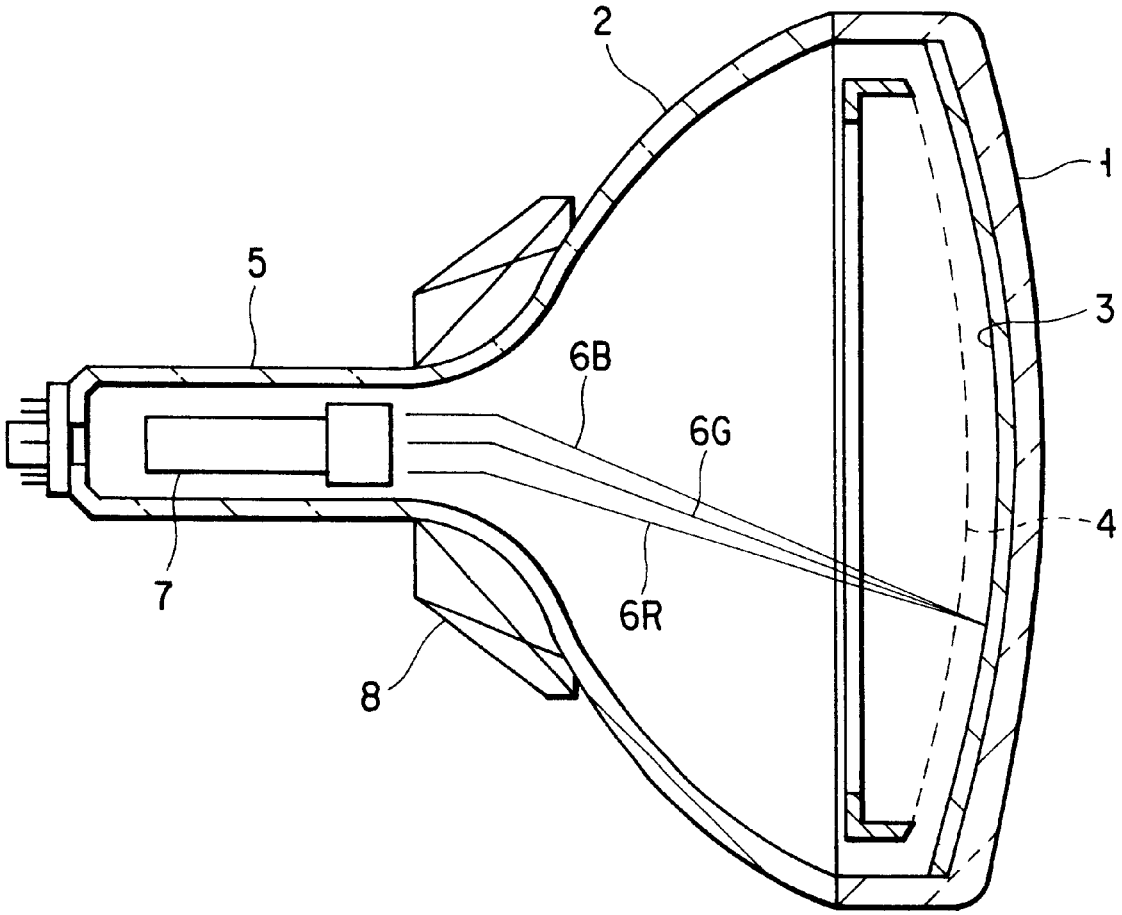
FIG. 2 is a schematic cross-sectional view of a color picture tube according to the present invention, taken along a line perpendicular to the inline direction.

FIG. 2 is a schematic view showing an example of the color picture tube according to the present invention. The color picture tube, as shown in FIG. 2, comprises an envelope formed of a panel 1 and a funnel 2 integrally joined to the panel 1. A phosphor screen 3 (target) made of a stripe or dotted three-color phosphor layer for emitting blue, green and red light is formed on the inner surface of the panel. A shadow mask 4, having a number of apertures i.e., electron beam passage holes, is mounted on a position opposite to the phosphor screen 3.

An electron gun 7 for emitting three electron beams 6B, 6G and 6R is arranged in the neck 5 of the funnel 2. A deflection yoke 8 for generating horizontal and vertical deflection fields is mounted on the outside of the funnel 2.

In the color picture tube having the structure described above, the three electron beams 6B, 6G and 6R emitted from the electron gun 7 are deflected by the horizontal and vertical deflection fields generated.by the deflection yoke 8. The phosphor screen 3 is scanned by the deflected beams via the shadow mask 4 in the horizontal and vertical directions. As a result, a color image is displayed.

The electron gun 7 used in this embodiment is an inline electron gun which emits three electron beams 6B, 6G and 6R in line: a center beam 6G and a pair of side beams 6B and 6R on both sides of the center beam, all traveling on the same horizontal plane.

Figure 3A:
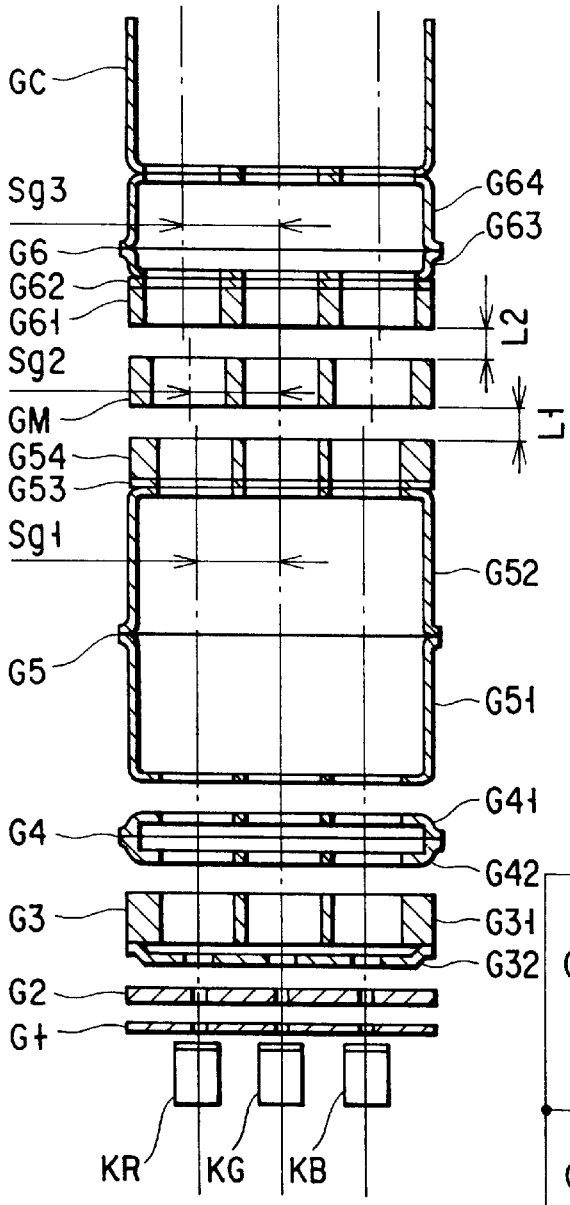
FIG. 3A is a schematic cross-sectional view of an electron gun applied to the color picture tube of the present invention, taken along a line perpendicular to the inline direction.
Figure 3B:
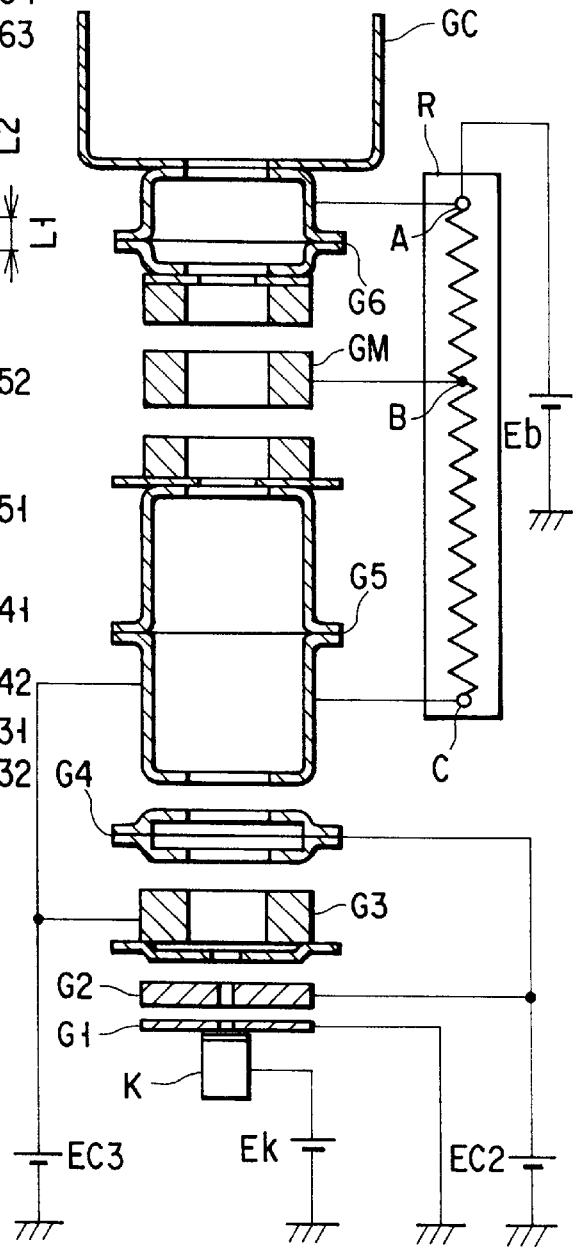
FIG. 3B is a schematic cross-sectional view of the electron gun shown in FIG. 3A, taken along a line in the inline direction.

FIG. 3A is a schematic cross-sectional view of an electron gun applied to the color picture tube of the present invention, taken along a line perpendicular to the inline direction, i.e., along the vertical direction. FIG. 3B is a schematic cross-sectional view of the electron gun, taken along a line in the inline direction, i.e., along the horizontal direction.

As shown in FIG. 3A, the electron gun comprises three cathodes KB, KG and KR disposed in a line, each incorporating a heater (not shown), for emitting electron beams for blue (B), green (G) and red (R). The electron gun further comprises a first grid G1, a second grid G2, a third grid G3, a fourth grid G4, a fifth grid G5, an intermediate electrode GM, a sixth grid G6 and a convergence cup GC. These grids are arranged in this order in the direction of travel of the electron beams and supported and fixed to each other by an insulating support (not shown).

A resistor R is provided near the electron gun, as shown in FIG. 3B. One end A of the resistor R is connected to the sixth grid G6, while the other end C is connected to the fifth grid G5. A substantially intermediate point B of the resistor R is connected to the intermediate electrode GM.

The first grid G1 is a thin plate electrode having three beam passage holes of a small diameter to allow passage of three electron beams emitted by three cathodes KB, KG and KR, respectively.

The second grid G2 is also a thin plate electrode having three beam passage holes of a small diameter to allow passage of the three electron beams passed through the first grid G1.

The third grid G3 is formed of a cup electrode G32 and a thick plate electrode G31. The cup electrode 32 of the third grid G3, on the side of the second grid G2, has three beam passage holes to allow passage of the three electron beams passed through the second grid G2. The beam passage holes formed in the cup electrode 32 has a diameter slightly larger than that of the beam passage holes formed in the second grid G2. The thick plate electrode G31 of the third grid G3, on the side of the fourth grid G4, has three beam passage holes having a large diameter.

The fourth grid G4 is formed of two cup electrodes G41 and G42, open ends of which are joined together. Each of the cup electrodes G41 and G42 has three beam passage holes, having the larger diameter, to allow passage of the three electron beams passed through the third grid G3.

The fifth grid G5 is formed of two cup electrodes G51 and G52, a thin plate electrode G53 and a thick plate electrode G54. The two cup electrodes G51 and G52 are extended in the direction of travel of the electron beams. The two cup electrodes G51 and G52, on the side of the fourth grid G4, are arranged such that open ends thereof are joined together. Each of the cup electrodes G51 and G52 has three beam passage holes to allow passage of the three electron beams passed through the fourth grid G4. A plate electrode G53 is arranged on that surface of the cup electrode G52, which includes the electron beam passage holes. The plate electrode G53 includes three electron beam passage holes, each of which has the major axis extended in the inline direction. The thick plate electrode G54, having three electron beam passage holes of a large diameter, is arranged on the surface of the plate electrode G53 on the side of the sixth grid G6.

The intermediate electrode GM is a thick plate electrode, having three beam passage holes of a large diameter to allow passage of the three electron beams passed through the fifth grid G5.

The sixth grid G6 is formed of a thick plate electrode G61, a thin plate electrode G62, and two cup electrodes G63 and G64 open ends of which are joined together. The thick plate electrode G61 has three beam passage holes, having a larger diameter, to allow passage of the three electron beams passed through the intermediate electrode GM. The plate electrode G62 includes three electron beam passage holes, which are long sideways in the inline direction and have a large diameter. Each of the cup electrodes G63 and G64 has three beam passage holes.

The convergence cup GC is fixed to that surface of the cup electrode G64 of the sixth grid G6, in which the three electron beam passage holes are formed.

As shown in FIG. 3B, a DC voltage Ek of about 100 to 150V and a modulation signal corresponding to an image superimposed thereon are applied to the three cathodes KB, KG and KR. The first grid G1 is grounded. The second and fourth grids G2 and G4 are connected to each other in the tube, and a DC voltage EC2 of about 600 to 800V is applied thereto. The third and fifth grids G3 and G5 are connected to each other in the tube, and a focusing voltage EC3 of about 6 to 9 kV is applied thereto. An anode voltage Eb of about 25 to 30 kV is applied to the sixth grid G6. A voltage of the value substantially intermediate between the voltages applied to the fifth and sixth grids G5 and G6 is applied to the intermediate electrode GM by means of the resistor R provided near the electron gun.

The cathodes KB, KG and KR, the first grid G1 and the second grid G2 constitute a triode. The triode emits electron beams and forms a crossover. The second and third grids G2 and G3 form a prefocus lens, which preliminarily focuses the electron beams emitted from the triode. The third, fourth and fifth grids G3, G4 and G5 form an auxiliary lens, which further preliminarily focuses the electron beams output from the prefocus lens. The fifth grid G5, the intermediate electrode GM and the sixth grid G6 constitute an extended field main lens of a large diameter and a long focus. With this lens, a smaller electron beam spot can be formed on the phosphor screen.

In the electron gun shown in FIGS. 3A and 3B, the main lens is constituted by three grids: the fifth grid, the intermediate electrode and the sixth grid (hereinafter referred to as the first, second and third electrodes, respectively). It is assumed that the gap between the first and second electrodes is L (1), the gap between the second and third electrodes is L (2), and the distances between the center axis of the central electron beam passage hole which allows passage of the central electron beam and that of a side electron beam passage hole which allows passage of the side electron beam in the first, second and third electrodes are Sg (1), Sg (2) and Sg (3), respectively.

Further, it is assumed that the voltages applied to the first, second and third electrodes are V (1), V (2) and V (3), respectively.

The amount HS1 of deflection of the side beams toward the center beam by the electron lens formed between the first and second electrodes is approximate to the value obtained by the following equation:

$$HS1 = A \times \frac{V(2) - V(1)}{L(1)} \times \{Sg(2) - Sg(1)\} \quad \text{(equation 3)}$$

where A is a constant determined by the shape and diameter of the beam passage holes.

In the same manner, the amount HS2 of deflection of the side beams toward the center beam by the electron lens formed between the second and third electrodes is approximate to the value obtained by the following equation.

$$HS2 = A \times \frac{V(3) - V(2)}{L(2)} \times \{Sg(3) - Sg(2)\} \quad \text{(equation 4)}$$

The amount HS of deflection of the side beams toward the center beam by the above two electron lenses: the lens formed between the first and second electrodes and the lens formed between the second and third electrodes, is approximate to the value obtained by the following equation.

$$HS = HS1 + HS2 = \left[\frac{\{V(2) - V(1)\}\{Sg(2) - Sg(1)\}}{L(1)} + \frac{\{V(3) - V(2)\}\{Sg(3) - Sg(2)\}}{L(2)}\right] \times A \quad \text{(equation 5)}$$

The condition that the total amount of deflection HS is not varied by the voltage V (2) applied to the second electrode is as follows.

$$\frac{\partial HS}{\partial V(2)} = \left[\frac{Sg(2) - Sg(1)}{L(1)} - \frac{Sg(3) - Sg(2)}{L(2)}\right] \times A \quad \text{(equation 6)}$$

From the equation (6), the distance Sg (2) between the center beam passage hole and a side beam passage hole in the second electrode is expressed by the following equation.

$$Sg(2) = \frac{L(1) \times Sg(3) + L(2) \times Sg(1)}{L(1) + L(2)} \quad \text{(equation 7)}$$

If the distance Sg (2) in the second electrode is determined so as to satisfy the equation 7, the amount of deflection of the side beam per unit voltage difference in the electron lens between the first and second electrodes is the same as that in the electron lens between the second and third electrodes.

In this state, if the voltage V (2) applied to the second electrode is increased by, for example, +ΔV, the amount ΔHS1 of change in deflection of the side beam by the electron lens between the first and second electrodes is expressed by the following equation.

$$\Delta HS1 = \left[\frac{Sg(2) - Sg(1)}{L(1)} \times (+\Delta V)\right] \times A = \left[\frac{Sg(3) - Sg(1)}{L(1) + L(2)} \times (+\Delta V)\right] \times A \quad \text{(equation 8)}$$

The amount ΔHS2 of change in deflection of the side beam by the electron lens between the second and third electrodes is expressed by the following equation.

$$\Delta HS2 = \left[\frac{Sg(3) - Sg(2)}{L(2)} \times (-\Delta V)\right] \times A = \left[\frac{Sg(3) - Sg(1)}{L(1) + L(2)} \times (-\Delta V)\right] \times A \quad \text{(equation 9)}$$

The amount ΔHS of total change in deflection of the side beam is expressed by the following equation.

$$\Delta HS = \Delta HS1 + \Delta HS2 = 0 \quad \text{(equation 10)}$$

Thus, the amount of change in deflection of the side beam by the electron lens between the first and second electrodes is offset by the amount of change in deflection of the side beam by the electron lens between the second and third electrodes. For this reason, even if the voltage applied to the second electrode varies, the amount ΔHS of total change in deflection of the side beam by the electron lens between the first and second electrodes and the electron lens between the second and third electrodes is zero. In other words, even if the voltage applied to the second electrode varies, the amount HS of total deflection of the side beam by the electron lens between the first and second electrodes and the electron lens between the second and third electrodes does not vary.

Therefore, while the color picture tube is operating, if a current leaks from the resistor which applies a voltage to the second electrode, with the result that the voltage of the second electrode becomes unstable, the paths of the side beams do not change. Consequently, the satisfactory convergence characteristic is maintained in all the region of the screen.

As described above, if the distance Sg (2) in the second electrode (the intermediate electrode) is determined so as to satisfy the aforementioned relationship, the amount of deflection of a side beam per unit voltage difference in the electron lens between the first electrode (the fifth grid G5) and the second electrode (the intermediate electrode GM) is the same as that in the electron lens between the intermediate electrode GM and the third electrode (the sixth grid G6). Therefore, even if the voltage applied to the intermediate electrode GM varies, the amount HS of total deflection of the side beam does not vary, because the change in path of the side beam by the electron lens between the fifth grid G5 and the intermediate electrode GM is offset by the change in path of the side beam by the electron lens between the intermediate electrode GM and the sixth grid G6.

Therefore, while the color picture tube is operating, if a current leaks from the intermediate point B of the resistor R which applies a voltage to the intermediate electrode GM, with the result that the voltage of the intermediate electrode GM becomes unstable, the paths of the side beams do not change. Consequently, the stable and satisfactory convergence is maintained in all the region of the screen.

In the embodiment as described above, the main lens portion is constituted by three grids. However, the present invention can be applied to the case where the main lens is constituted by an n-number of grids, if the distance Sg (k) of a k-th grid is determined as follows in which case, the same effect as described above can be obtained.

In this case, the main lens portion is constituted by an n-number of grids (first, second, . . . k-th, . . . and n-th grids), arranged in this order from the cathode side in the direction of travel of the electron beams. The nearer to the cathode, the lower the voltage applied to the grid. It is assumed that the gap between the first and second grids is L (1), the gap between the second and third grids is L (2), and the gap between the k-th and (k+1)-th grids is L (k). It is also assumed that the distances between the center axis of the central electron beam passage hole and that of a side electron beam passage hole in the first, second and k-th grids are Sg (1), Sg (2) and Sg (k), respectively. The distance Sg (k) between the center beam passage hole and the side beam passage hole in the k-th grid is determined to substantially satisfy the relationship expressed by the following equation.

$$Sg(k) = \frac{L(k-1) \times Sg(k+1) + L(k) \times Sg(k-1)}{L(k-1) + L(k)} \quad \text{(equation 11)}$$

If the distance Sg (k) in the k-th grid is determined so as to satisfy the equation 11, the amount of deflection of a side beam per unit voltage difference in the electron lens between the (k−1)-th and k-th grids is the same as that in the electron lens between the k-th and (k+1)-th grids. For this reason, if the voltage in the k-th grid varies, the amounts of change in deflection of the side beam by these electron lenses are offset by each other.

$$\Delta HS=\Delta HS(k-1)+\Delta HS(k)=0 \quad \text{(equation 12)}$$

Thus, even if the voltage applied to the k-th grid varies, the amount HS of total deflection of the side beam by the electron lens between the (k−1)-th and k-th grids and the electron lens between the k-th and (k+1)-th grids can be kept constant.

Therefore, while the color picture tube is operating, if a current leaks from the resistor which applies a voltage to the k-th grid, with the result that the voltage of the k-th grid become unstable, the paths of the side beams do not change. Consequently, the satisfactory convergence is maintained in all the region of the screen.

In the above embodiment, the end C of the resistor is connected to the fifth grid GS. However, the end C can be connected to voltage supply means provided outside of the color picture tube, or it can be grounded.

The plate electrodes of the fifth and sixth grids G5 and G6 have three electron beam passage holes, each of which has the major axis extended in the inline direction in the above embodiment. However, the electron beam passage holes are not limited to this shape, but can be shape having a major axis in the vertical direction or can be a circle.

As has been described above, the color picture tube of the present invention comprises a resistor within the neck and an extended field electron gun including a main lens of a long focus and large diameter, by which the focusing performance in the overall region of the screen is greatly improved. The main lens portion of the electron gun is constituted by an n-number of grids (first, second, . . . k-th, . . . and n-th grids), arranged in this order from the cathode side in the direction of travel of the electron beams. The nearer to the cathode, the lower the voltage applied to the grid. Assuming that the gap between the first and second grids is L (1), the gap between the second and third grids is L (2), and the gap between the k-th and (k+1)-th grids is L (k), and that the distances between the center axis of the central electron beam passage hole and that of a side electron beam passage hole in the first, second and k-th grids are Sg (1), Sg (2) and Sg (k), respectively, in this case the distance Sg (k) between the center beam passage hole and a side beam passage hole in the k-th grid is determined to substantially satisfy the relationship expressed by the following equation.

$$Sg(k)=\frac{L(k-1)\times Sg(k+1)+L(k)\times Sg(k-1)}{L(k-1)+L(k)} \quad \text{(equation 13)}$$

If the distance Sg (k) in the k-th grid is determined so as to satisfy this equation, the amount of deflection of a side beam per unit voltage difference in the electron lens formed between the (k−1)-th and k-th grids is the same as that in the electron lens formed between the k-th and (k+1)-th grids. For this reason, if the voltage in the k-th grid varies, the amounts of change in deflection of the side beam by these electron lenses are offset by each other. Thus, the amount HS of total deflection of the side beam by the electron lens formed between the (k−1)-th and k-th grids and the electron lens formed between the k-th and (k+1)-th grids is kept constant.

Therefore, while the color picture tube is operating, if a current leaks from the resistor which applies a voltage to the k-th grid, with the result that the voltage of the k-th grid becomes unstable, the paths of the side beams do not change. Consequently, the satisfactory convergence is maintained in all the region of the screen. Thus, the present invention provides a considerable technical advantage in industry.

As described above, the present invention eliminates the problem of the conventional art; that is, it prevents a change in convergence due to a current leaked from the resistor during an operation of the color picture tube. Thus, it is possible to provide a color picture tube in which convergence characteristic due to a change in path of a side beam is prevented from changing, so that a stable and satisfactory convergence characteristic in the overall region of the screen can be obtained.

What is claimed is:

1. A color picture tube comprising: an inline electron gun including an electron beam generating portion (KR, KG, KB, G1, G2) for generating three electron beams in line consisting of a center beam (6G) and a pair of side beams (6R, 6B) on both sides of the center beam, all traveling on a same horizontal plane, and a main electron lens portion (G5, GM, G6) formed of a plurality of grids for focusing the three electron beams on a target (3); and a deflection yoke for generating a magnetic field for deflecting the electron beams emitted from the electron gun to scan the target, characterized in that p1 the main electron lens portion comprises an n-number of grids said n-number of grids comprising first, second, . . . k-th, . . . and n-th grids, arranged in this order in a direction of travel of the electron beams, the first and second grids being separated by a gap L (1), the second and third grids being separated by a gap L (2), and the k-th and (k+1)-th grids being separated by a gap L (k), and the (k−1)-th grid (GS), the k-th grid (GM) and the (k+1)-th grid (G6), forming at least two adjacent gaps L (k−1) and L (k), comprising deflection means for deflecting the paths of the pair of side beams on the same horizontal plane, the deflection means comprised of the (k−1)-th grid, the k-th grid and the (k+1)-th grid is constructed so that an amount of deflection of the side beams per unit voltage difference in the gap L (k−1) is substantially equal to an amount of deflection of the side beams per unit voltage difference in the gap L (k), and the k-th grid is connected to a substantially intermediate point (B) of a resistor (R) having one end (C) connected to the (k−1)-th grid and another end (A) connected to the (k+1)-th grid, so that a substantially intermediate potential between a voltage applied to the (k−1)-th grid and a voltage applied to the (k+1)-th grid is applied to the k-th grid.

2. A color picture tube comprising: an inline electron gun including an electron beam generating portion (KR, KG, KB, G1, G2) for generating three electron beams in line consisting of a center beam (6G) and a pair of side beams (6R, 6B) on both sides of the center beam, all traveling on a same horizontal plane, and a main electron lens portion (G5, GM, G6) formed of a plurality of grids for focusing the three electron beams on a target (3); and a deflection yoke for generating a magnetic field for deflecting the electron beams emitted from the electron gun to scan the target, characterized in that said main electron lens portion comprises an n-number of grids said n-number of grids comprising first, second, . . . k-th, . . . and n-th grids, arranged in this order in a direction of travel of the electron beams, the first and second grids being separated by a gap L (1), the second and third grids being separated by a gap L (2), and the k-th and (k+1)-th grids being separated by a gap L(k), the (k−1)-th grid, the k-th grid and the (k+1)-th grid forming at least two adjacent gaps L(k−1) and L(k), comprising deflection means for deflecting the paths of the pair of side beams on the same horizontal plane, wherein distances between a center axis of a center beam passage hole in which said center beam passes through and that of each side beam passage holes in which side beams pass through are represented by Sg (1), Sg (2) and Sg (k) in the first, second and k-th grids, said distance Sg (k) in the k-th grid set to substantially satisfy the relationship:

$$Sg(k) = \frac{L(k-1) \times Sg(k+1) + L(k) \times Sg(k-1)}{L(k-1) + L(k)}.$$

3. The color picture tube according to claim 2, characterized in that the k-th grid is connected to a substantially intermediate point (B) of a resistor (R) having one end (C) connected to the (k−1)-th grid and another end (A) connected to the (k+1)-th grid, so that a substantially intermediate potential between a voltage applied to the (k−1)-th grid and a voltage applied to the (k+1)-th grid is applied to the k-th grid.

4. The color picture tube according to claim 2, wherein said center axes of the pair of side beam passage holes formed in each grid constituting said main electron lens portion are decentered from those of the grids adjacent thereto.

5. The color picture tube according to claim 2, wherein the following relationship is satisfied:

$$Sg(k-1) \neq Sg(k) \neq Sg(k+1).$$

* * * * *